US011944202B2

(12) United States Patent
Olson

(10) Patent No.: US 11,944,202 B2
(45) Date of Patent: Apr. 2, 2024

(54) FOLDING HEADREST STAND

(71) Applicant: Steven Olson, Bellevue, WA (US)

(72) Inventor: Steven Olson, Bellevue, WA (US)

( * ) Notice: Subject to any disclaimer, the term of this patent is extended or adjusted under 35 U.S.C. 154(b) by 160 days.

(21) Appl. No.: 17/406,714

(22) Filed: Aug. 19, 2021

(65) Prior Publication Data

US 2023/0057611 A1 Feb. 23, 2023

(51) Int. Cl.
*A47C 16/00* (2006.01)
*A47C 7/38* (2006.01)

(52) U.S. Cl.
CPC ..... *A47C 16/00* (2013.01); *A47C 7/383* (2013.01)

(58) Field of Classification Search
CPC .... B64D 11/0642; B60N 2/882; B60N 2/806; B60N 2/838; A47C 7/383; A47C 16/00; A61G 13/121
See application file for complete search history.

(56) References Cited

U.S. PATENT DOCUMENTS 6,684,431 B2 * 2/2004 Splane, Jr. ..... A47C 20/026 5/640
6,698,045 B1 * 3/2004 Coppens ..... A61G 13/12 128/869
7,364,129 B1 * 4/2008 Levari, Jr. ..... A47G 23/0216 108/4
D803,610 S * 11/2017 Jackow ..... D6/716.5
10,159,354 B2 * 12/2018 Rayburn ..... A47C 16/00
10,226,130 B2 * 3/2019 Hill ..... B60N 3/001
2003/0172462 A1 * 9/2003 Hoggatt ..... A47C 20/023 5/636
2009/0077749 A1 * 3/2009 Roleder ..... A61G 13/12 5/637
2011/0277238 A1 * 11/2011 Mabry ..... A47C 16/00 5/112
2013/0232696 A1 * 9/2013 Halimi ..... A47C 16/00 5/640
2015/0001905 A1 * 1/2015 Jackow ..... A47C 7/383 297/397
2015/0282628 A1 * 10/2015 Hill ..... A47C 20/02 297/391
2016/0120326 A1 * 5/2016 Belleh ..... B60N 2/806 297/391
2016/0331126 A1 * 11/2016 Mills ..... F16M 11/26
2020/0198786 A1 * 6/2020 Olson ..... B64D 11/0638

* cited by examiner

*Primary Examiner* — Kyle J. Walraed-Sullivan
(74) *Attorney, Agent, or Firm* — DEAN A. CRAINE, P.S.

(57) ABSTRACT

A compact headrest stand that selectively unfolds to support a user's head over a support surface. The stand includes a lower member pivotally attached to an upper member. A downward-extending lip configured to capture the edge of a support surface is formed on the opposite edge of the lower member. The upper member includes a center void and two support arms, each with a saddle clip. Attached to the saddle clips is a headrest assembly configured to support the user's forehead and facial bones. During use, the lower member is placed on a support surface, and the upper member is rotated upward and diagonally aligned over the lower member. The headrest is placed on the saddle clips and can swivel between the two support arms. Attached to the lower member is a stop leaf that, when diagonally aligned, holds the upper member diagonally over the lower member.

19 Claims, 13 Drawing Sheets

FOLDING HEADREST STAND

This non-provisional patent application is based on and claims the filing date benefit of the U.S. Provisional Patent Application (63/067,635) filed on Aug. 19, 2020.

Notice is given that the following patent document contains original material subject to copyright protection. Accordingly, the copyright owner has no objection to the facsimile or digital download reproduction of all or part of the patent document but otherwise reserves all copyrights.

BACKGROUND OF THE INVENTION

1. Field of the Invention

A folding headrest stand is temporarily set up on a surface to either support a user's head when leaning forward over the surface or hold a book or tablet computer diagonally in an elevated position above the surface.

2. Description of the Related Art

When sitting in a chair adjacent to a table or desk, some individuals desire to lean forward over the table and desk when sitting and rest their heads of an elevated surface. In some instances, the user must bend forward and rest his head directly on the table or desk or his arms spread horizontally over the table or desk. In some instances, the user uses his arms and hands to support his head in an elevated position over the table or desk. In both instances, most users find resting in these positions uncomfortable after a few minutes.

Most passengers in a passenger airline find sitting upright or at a steep angle in, their assigned seat for extended periods uncomfortable. Unfortunately, most adults cannot bend forward and rest their beads on the tray table.

What is needed is a portable headrest stand that may be selectively folded into a compact configuration and easily unfolded and placed on a support surface, such as a tray table, a standard table, or a desk, and used to support a user's head in an elevated position when leaning forward over the support surface.

SUMMARY OF THE INVENTION

It is an object of the invention to provide a portable, compact, folding headrest stand that, when unfolded on a surface, supports a user's head when leaning forward over the flat support surface.

The first embodiment of the headrest stand includes a lower member pivotally attached along its distal edge to an upper member. Formed on the proximal edge of the lower member is at least one downward extending lip that captures an edge of the support surface when the lower member is placed over the top surface of the support surface or object.

Disposed between the distal end of the lower member and the proximal end of the upper member is a first hinge that allows the upper member to extend diagonally upward and folded over the lower member. The upper member is folded over the lower member for a compact configuration. Before use, the upper member is rotated upward over the lower member when the lower member is placed on a support surface. The upper member includes a sizeable center void formed between two support arms. Attached or formed on the distal end of each arm is a saddle clip.

When assembled, a headrest assembly is suspended between the two saddle clips. The headrest assembly includes a downward curved body covered by a cushion configured to support the user's forehead and sides of the face when placed onto the headrest assembly. Formed on the curved body is a nose opening that accommodates the user's nose when the user's forehead is placed against the curved body. Attached to the opposite sides of the curved body are outward extending hubs that are selectively captured by the saddle clips.

Attached to the inside surface of the lower member is a rotating stop leaf. The stop leaf fits inside a complimentary-shaped cutout formed on the lower member, enabling the upper member to fold and stack over the lower member. When the lower member is placed over a support surface, and the stop surface is rotated rearward and pressed against the inside surface of the upper member to hold the upper member in a diagonal orientation over the lower member. An optional slot or detent is formed on the inside surface of the upper member engaged by, the distal end of the stop leaf to securely hold the stop leaf in a diagonal position.

An optional ledge is formed or attached to the proximal end on the lower member to support a tablet computer or book.

In a second embodiment, an intermediate member is disposed between the lower member and the upper member which positions the headrest assembly at a high, elevated position above the support surface. The first hinge pivotally attaches the proximal end of the intermediate member to the lower member. Formed on the proximal end of the intermediate member is a second hinge that pivotally attaches the upper member to the intermediate member. Formed on the intermediate member is an outward extending, transversely aligned first ledge. Formed or attached to the distal end of the upper member is an outward extending, transversely aligned second ledge.

Formed or attached to the distal end of the upper member is an extension lip that presses against the inside surface of the intermediate member the limits the forward rotational movement of the upper member over the intermediate member so that the upper member is longitudinally aligned with the intermediate member.

DESCRIPTION OF THE PREFERRED EMBODIMENT(S)

Figure 1:
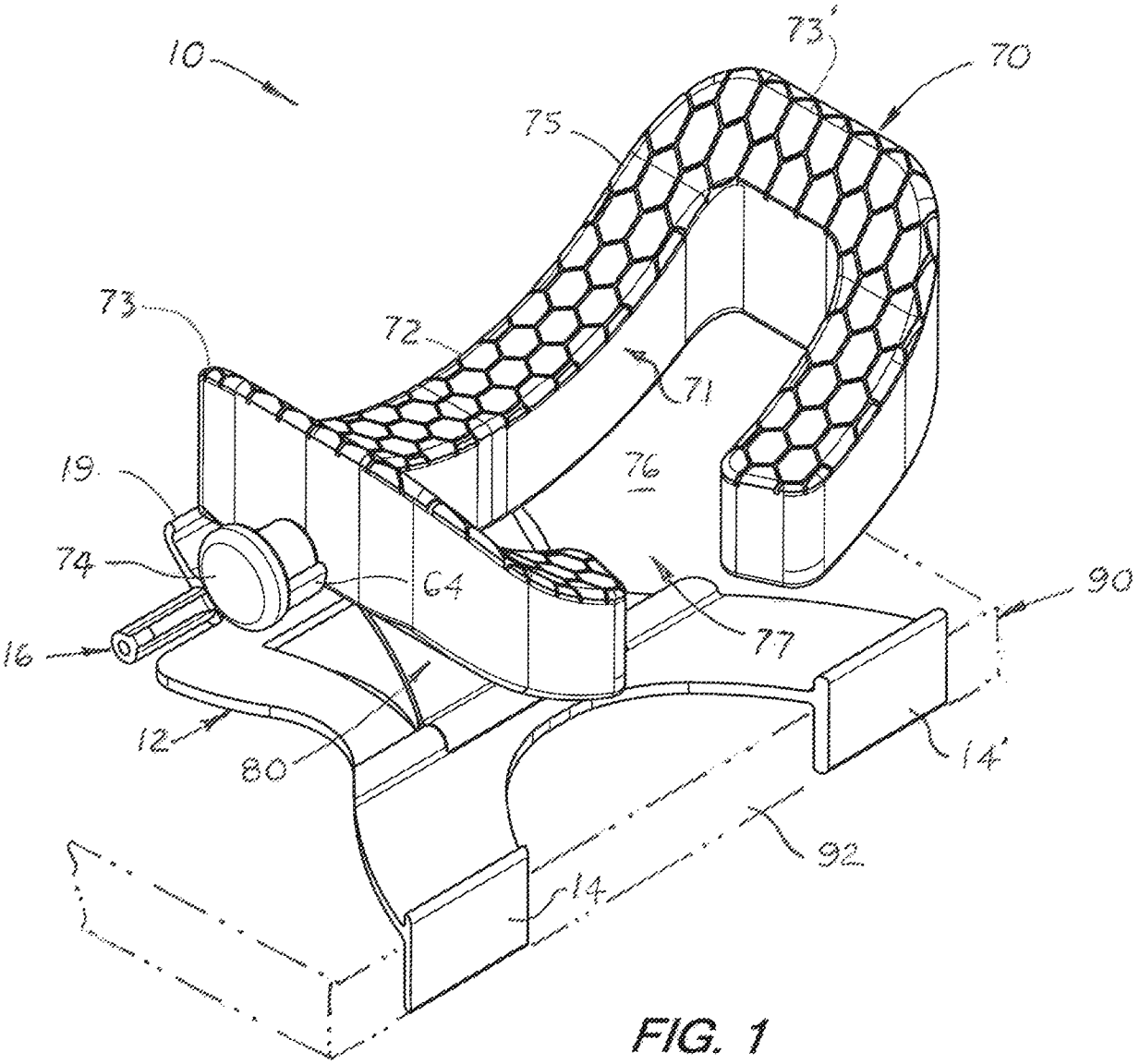
FIG. 1 is a front perspective view of the folding headrest stand in an extended configuration.

A compact, folding headrest stand 10 designed to be stored in a compact, folded configuration and then selectively unfolded and used to support a user's head over a support surface 90.

The headrest stand 10 includes a lower member 12 pivotally attached along its distal edge to an upper member 30. In the Figs, the lower member 12 and the upper member 30 are flat, planer structures. It should be understood, however, that they may be other shapes. Formed on the proximal edge of the lower member 12 is at least one downward extending lip 14 (two lips 14, 14' shown) that captures the edge 92 on the support surface 90. Formed on the distal end of the lower member 12 is a first hinge 16 that pivotally attaches the upper member 30 to the lower member 12. Also formed on the distal end of the lower member 12 is a first ledge 19 configured to hold a book or device over the outside surface of the upper member 30. In the embodiment shown in the Figs, the first ledge 19 is u-shaped with an inside leg 19A that presses against the outside surface of upper member 30 to prevent excessive forward movement of the upper member 30 over the lower member 12.

Figure 6:
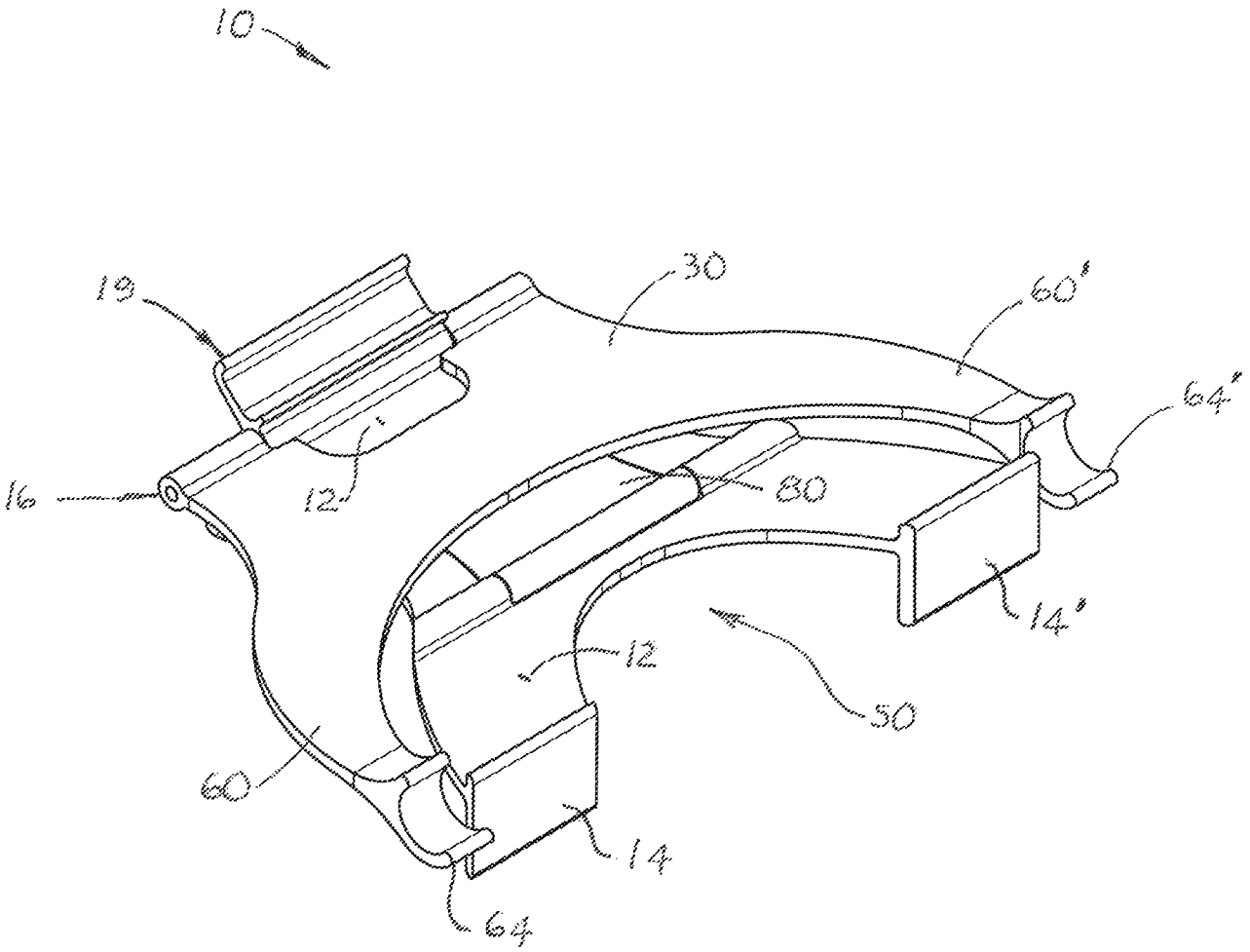
FIG. 6 is a front perspective view of the folding headrest stand in a folded configuration with the headrest removed.
Figure 7:
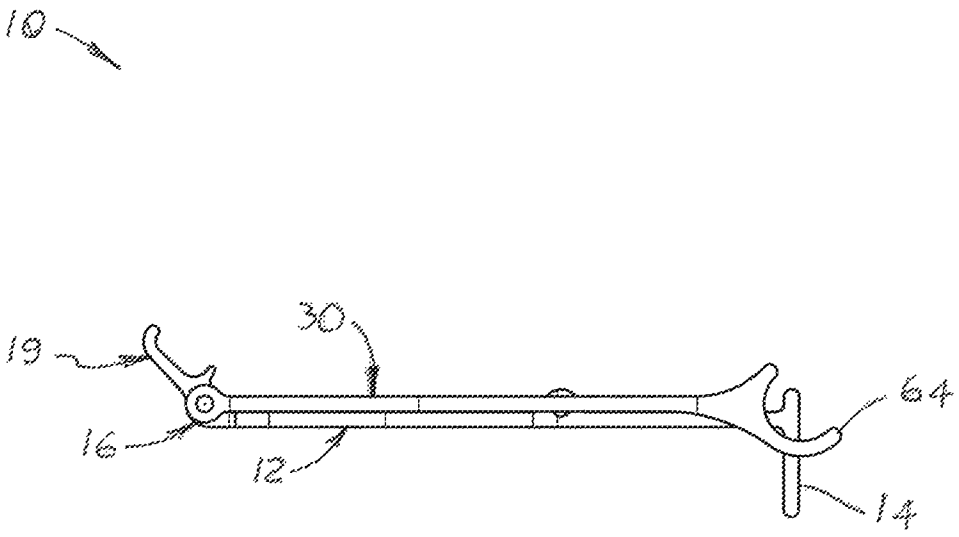
FIG. 7 is a left side elevational view of the folding headrest stand shown in FIG. 6.
Figure 8:
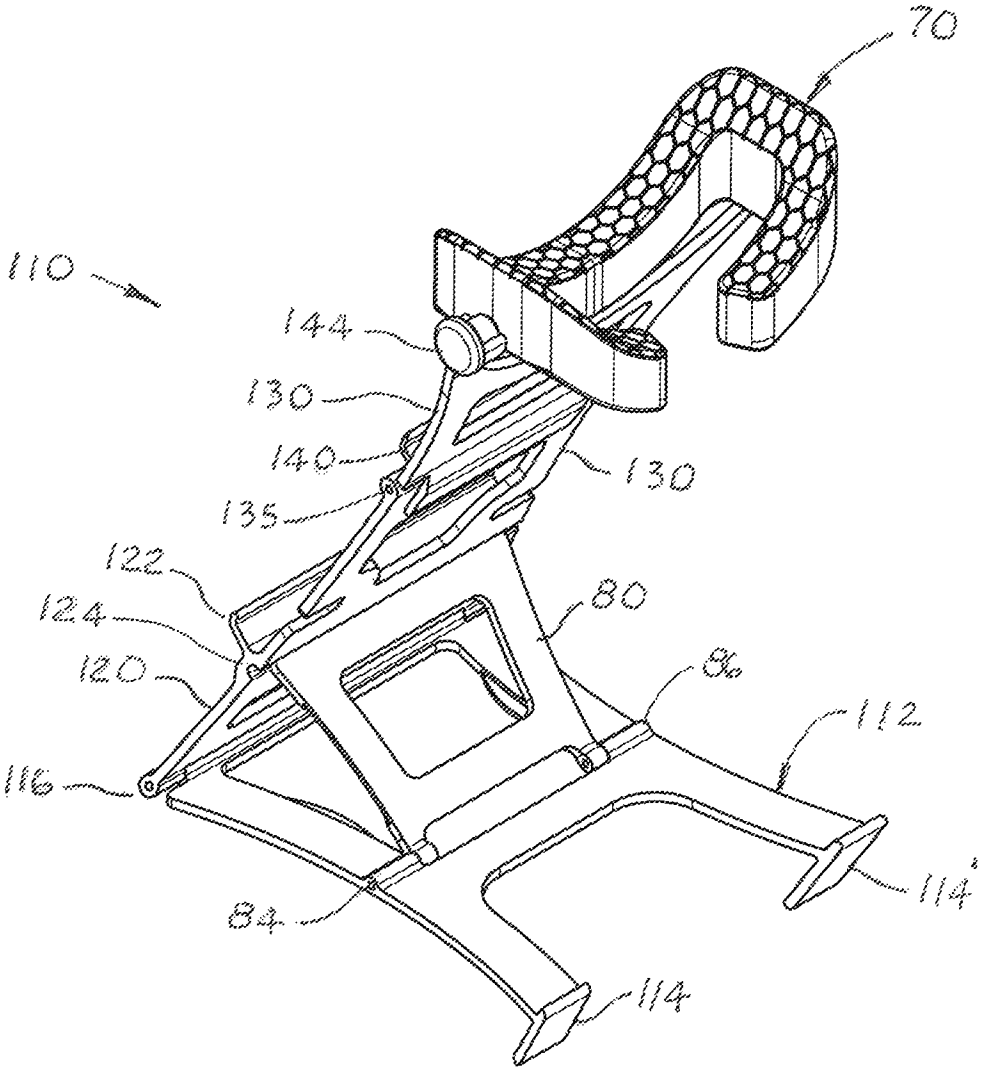
FIG. 8 is a perspective view of a second embodiment of the headrest stand that includes an intermediate member between the lower member and the upper member.

As shown in FIG. 6, the upper member 30 includes a large center void 50 and two support arms 60, 60' on opposite sides of the center void 50. Each support arm 60, 60' includes a saddle clip 64, 64', respectively.

Figure 2:
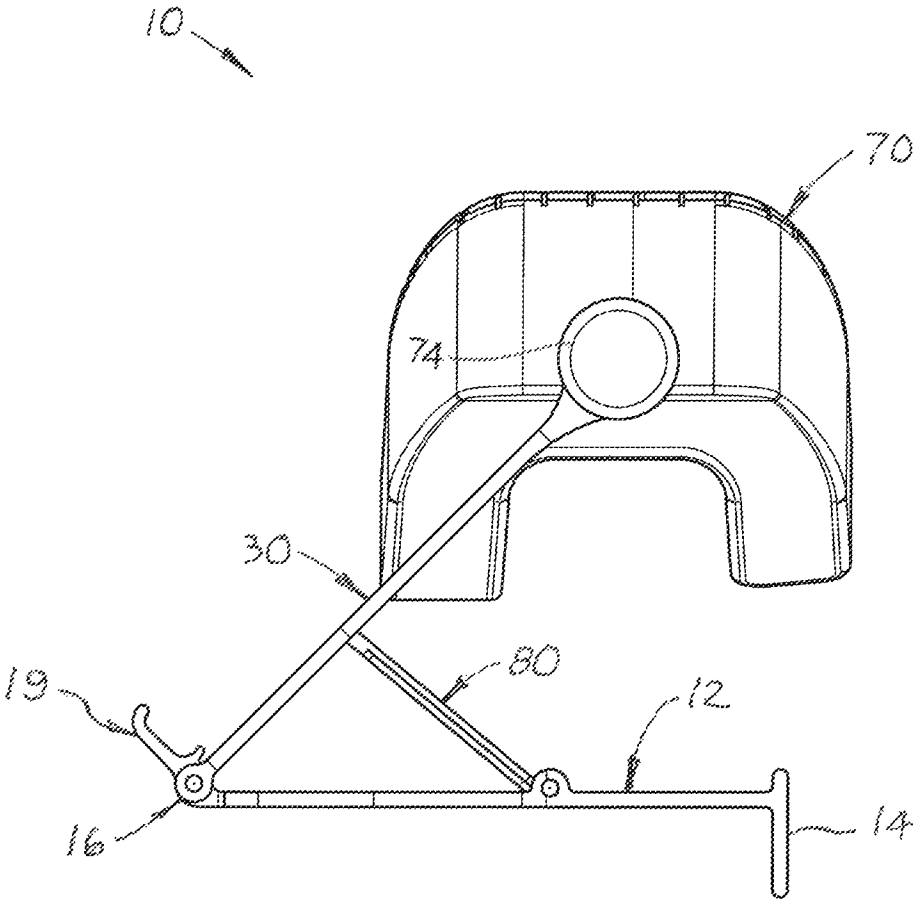
FIG. 2 is a left-side elevational view of the folding headrest stand shown in FIG. 1.
Figure 3:
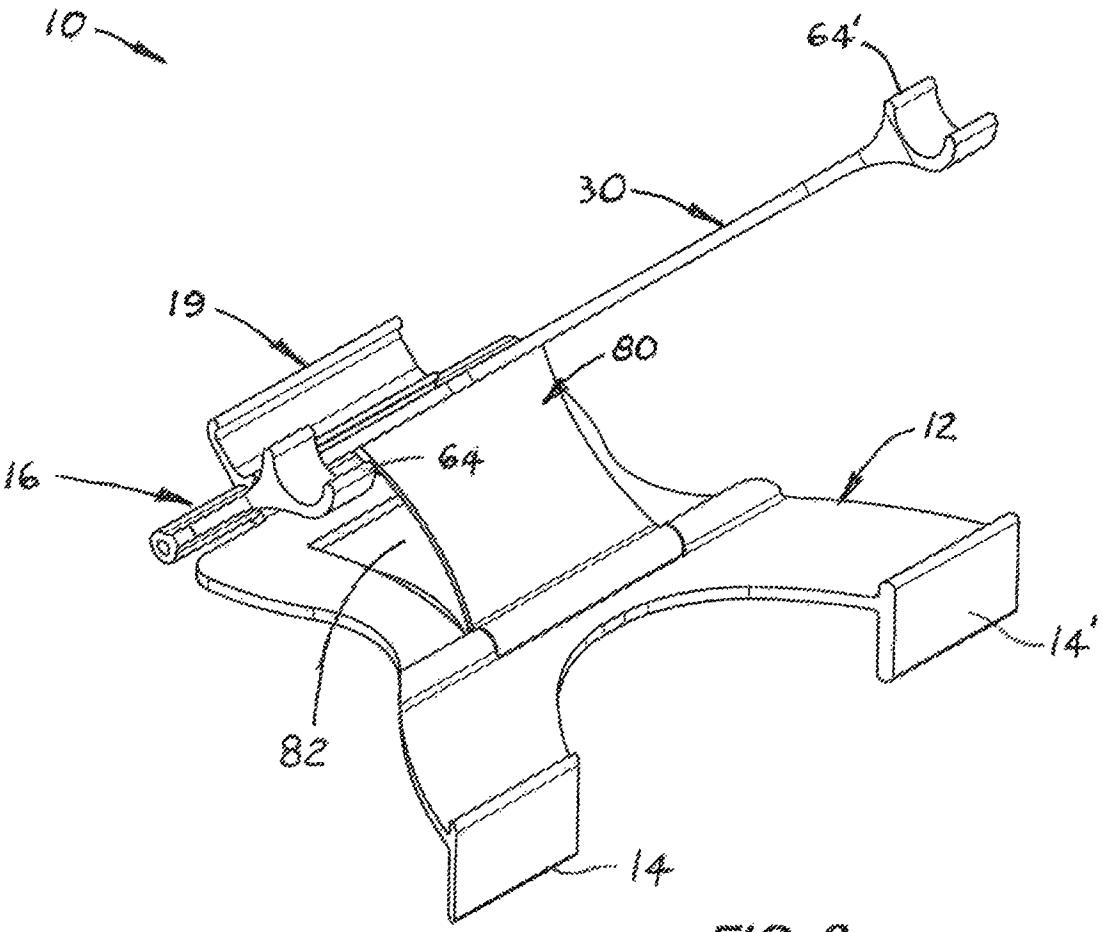
FIG. 3 is a front perspective view of the folding headrest stand in an extended configuration with the headrest assembly removed.
Figure 4:
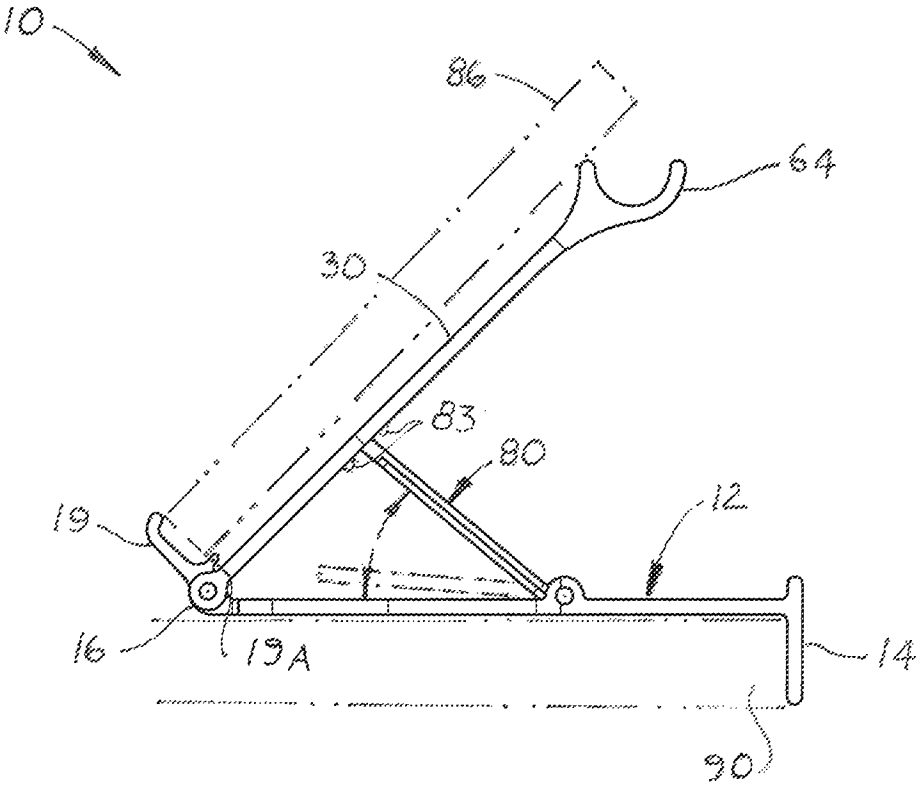
FIG. 4 is a left-side elevational view of the folding headrest stand shown in FIG. 3.
Figure 5:
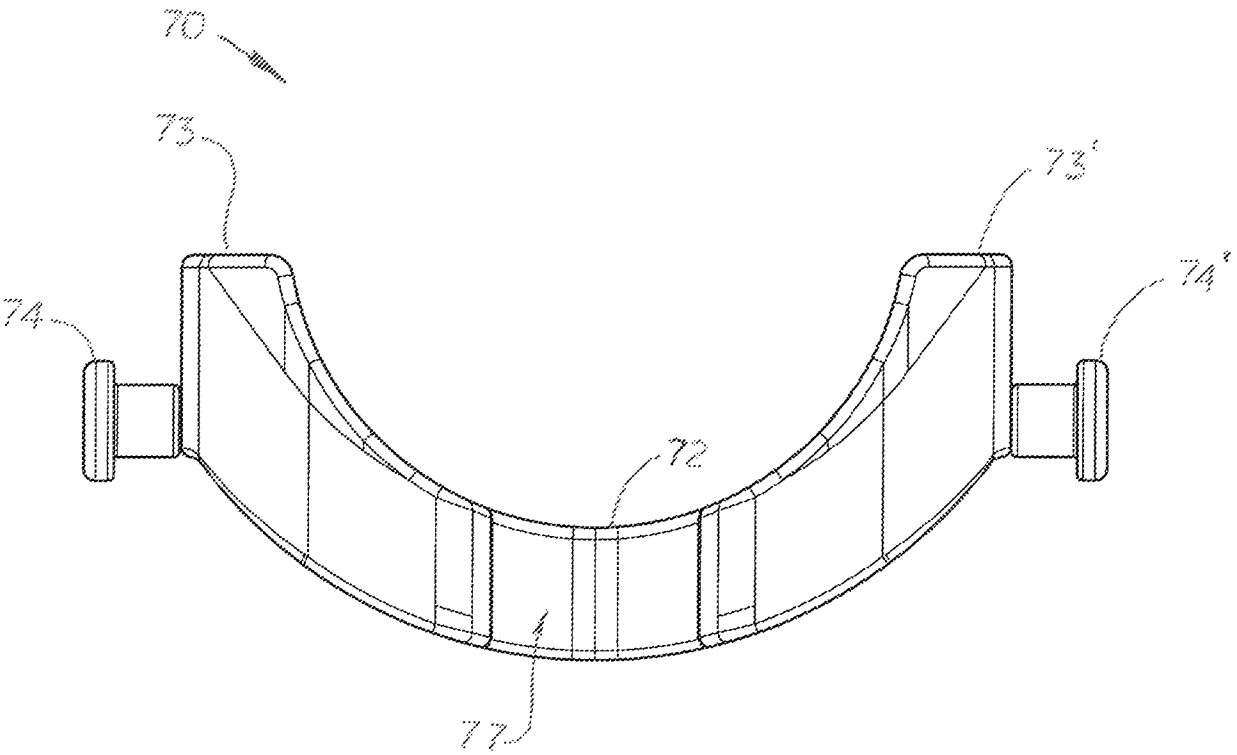
FIG. 5 is a front elevational view of the headrest assembly.

Suspended between and attached to the saddle clips 64, 64' is a headrest assembly 70 shown in FIGS. 1, 2 and 5. The headrest assembly 70 includes a curved, thin u-shaped body 71 with a concave, upper transverse member 72 and two downward extending two side arms 73, 73'. Extending outward from each side arm 73, 73' is an outward extending hub 74, 74'. Each hub 74, 74' are sufficiently spaced apart and designed to be captured by the saddles clip 64, 64'. During use, the headrest assembly 70 is placed over the upper member 30 so that the hubs 74, 74', respectively, fit into the saddle clips 64, 64' to support the headrest assembly 70 in an elevated position over the lower member 12. The ends of the two side arms 73, 73' are spaced apart and detached thereby creating a nose relief slot 77 that receives the user's nose when the user's head is placed over the body 71. The inside surface of the headrest assembly 70 may be covered by a complimentary-shaped cushion cover 75 for greater comfort. The headrest assembly 70 is configured to evenly distribute the weight of the user's head over the user's forehead and zygomas. In the preferred embodiment, the headrest assembly 70 is sufficient wide and long to accommodate glasses worn by the user.

Pivotally attached to the inside surface of the lower member 12 along one edge is rotating stop leaf 80. In the embodiment shown herein, the stop leaf 80 is stored in a complimentary-shaped cutout 82 formed on the lower member 12. For compact storage, the stop leaf 80 is folded into the cutout 84, enabling the upper member 30 to be rotated and stacked directly above the lower member 12, as shown in FIG. 6.

Formed on the inside surface of the upper member 30 are optional stop detents 83. When the stop leaf 80 is diagonally aligned, the distal end of the stop leaf 80 engages the detents 83 to prevent movement of the stop leaf 80 on the upper member 30. When the upper member 30 is rotated upward during use, and the stop leaf 80 is rotated upward from lower member 12 to the desired position to support the upper member 30 in the diagonal position.

FIGS. 8-13 show a second embodiment of the headrest stand 110, which includes an intermediate member 120 disposed between the lower member 112 and the upper member 130. When the headrest assembly 70 is attached to the upper member 130, the intermediate member 120 positions the headrest assembly 70 at a higher, elevated position above the support surface 90.

Figure 9:
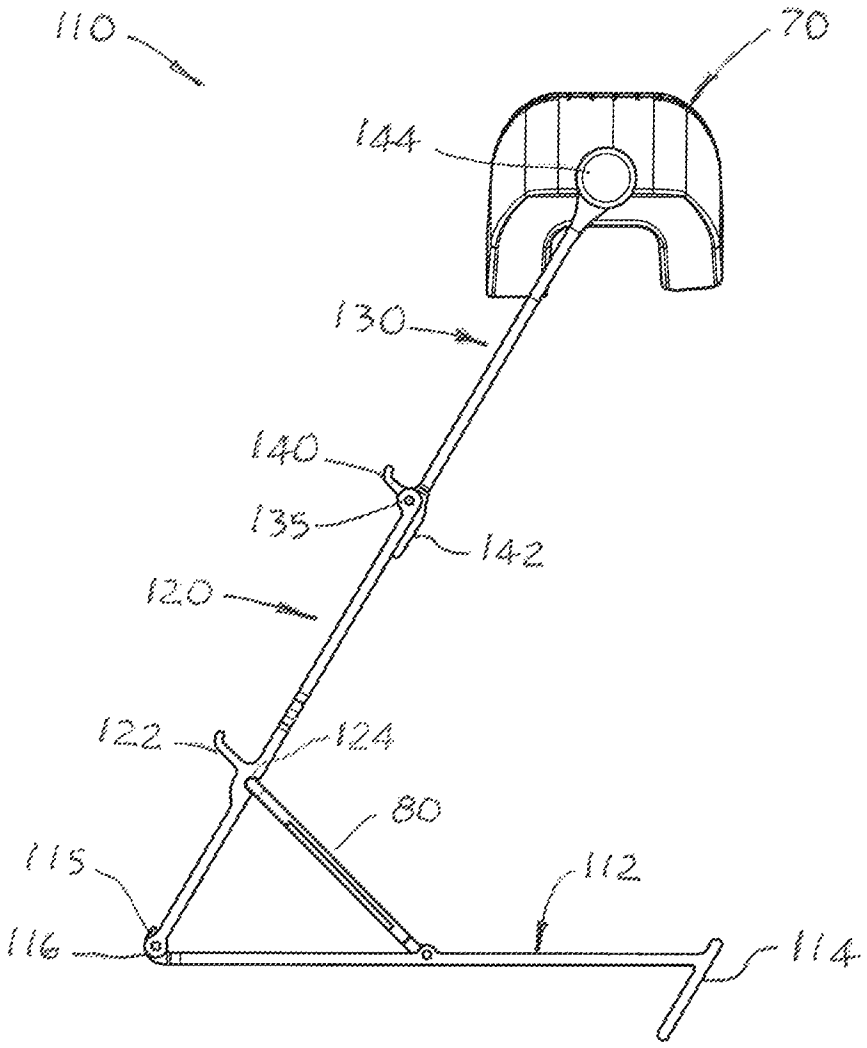
FIG. 9 is a side elevational view of the headrest stand shown in FIG. 8.
Figure 10:
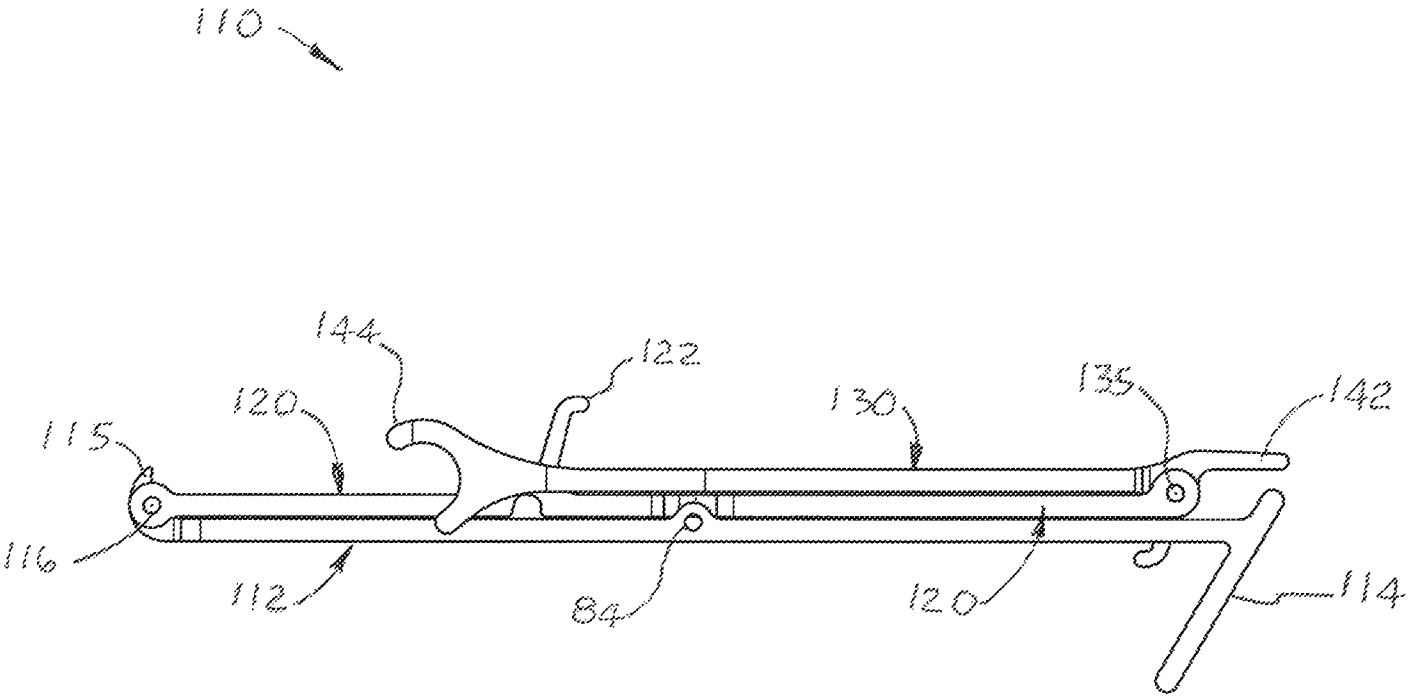
FIG. 10 is a side elevational view of the intermediate member and upper member folded over the lower member.

The lower member 112 is similar to the lower member 12 used with the headrest standing 10. The lower member 112 includes at least one downward extending lip 114 (two lips 114, 114' shown) that captures the edge 92 on the support surface 90. Formed on the distal end of the lower member 112 is a first hinge 116 that pivotally attaches the intermediate member 120 to the lower member 112. As shown in FIG. 9, formed or attached to the distal end of the lower member 112 is an optional extension lip 115 that prevents excessive forward rotation of the intermediate member 120 on the lower member 110.

The intermediate member 120 is a planar structure pivotally attached to the lower member 112 via the first hinge 116. Formed or attached to the immediate member 120 is an outward extending lower ledge 122. The lower ledge 122 is configured to hold a book or tablet computer diagonally. The distal edge of the intermediate member 120 connects to the upper member 130 via a second hinge 135. Formed on the inside surface of the intermediate member 120 is an optional, transversely aligned slot 124 that receives the distal edge of the stop member 80.

The upper member 130 used in headrest stand 110 is similar to the upper member 30 used in the headrest stand 10. The upper member 130 includes two support arms 132, 132' separated by a large center void 134. Each support arm 132, 132' includes a saddle clip 144, 144", respectively.

Suspended between and attached to the saddle clips 144, 144' is the headrest assembly 70 used in the headrest stand 10.

Formed or attached to the proximal end of the upper member 130 is an optional, forward extending upper ledge 140. When the upper member 130 is rotated around the second hinge 135, the upper ledge 140 travels through a slot opening 129 formed along the distal end of the intermediate member 120.

Figure 11:
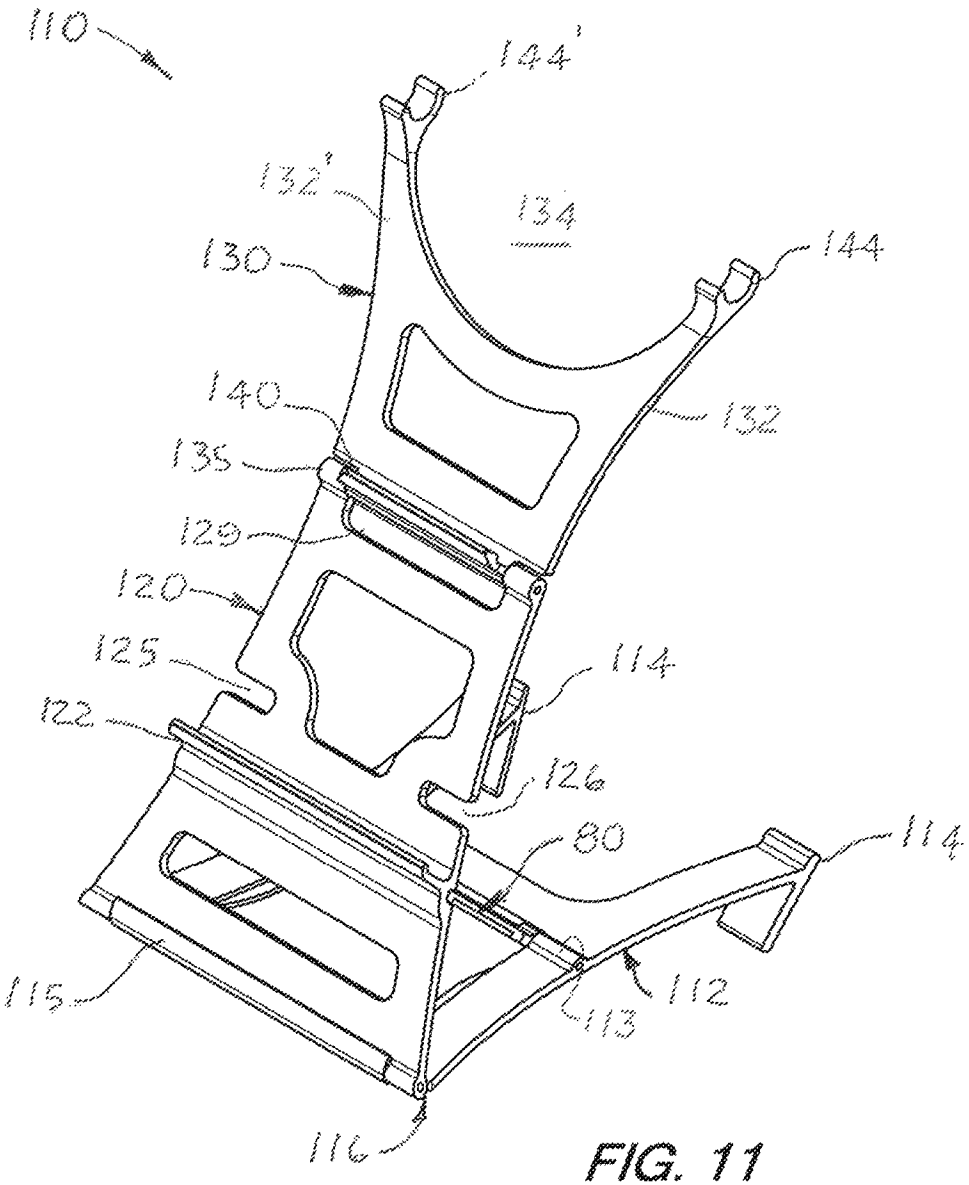
FIG. 11 is a front perspective view showing the intermediate member and upper member axially aligned and extended diagonally over the lower member.
Figure 12:
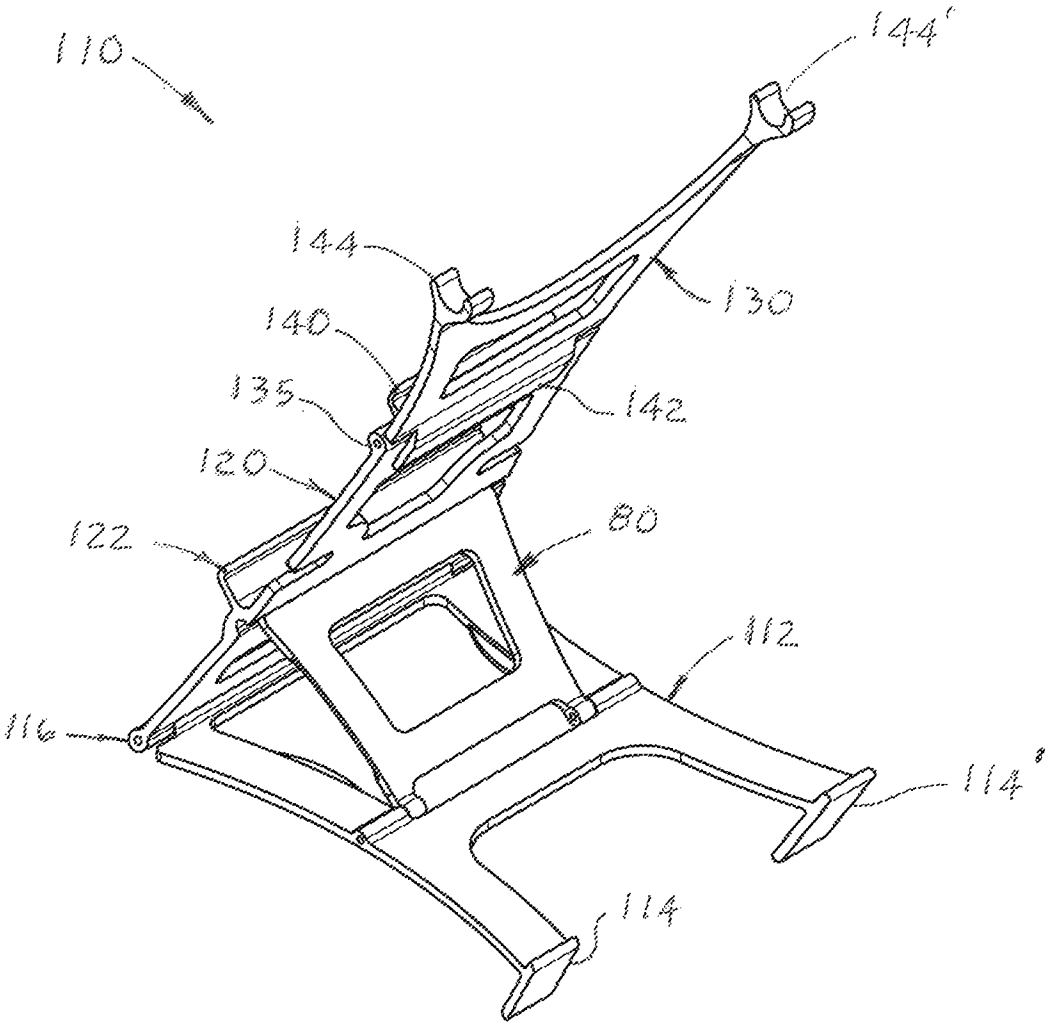
FIG. 12 is a rear perspective view showing the intermediate member and upper member axially aligned and extended diagonally over the lower member.
Figure 13:
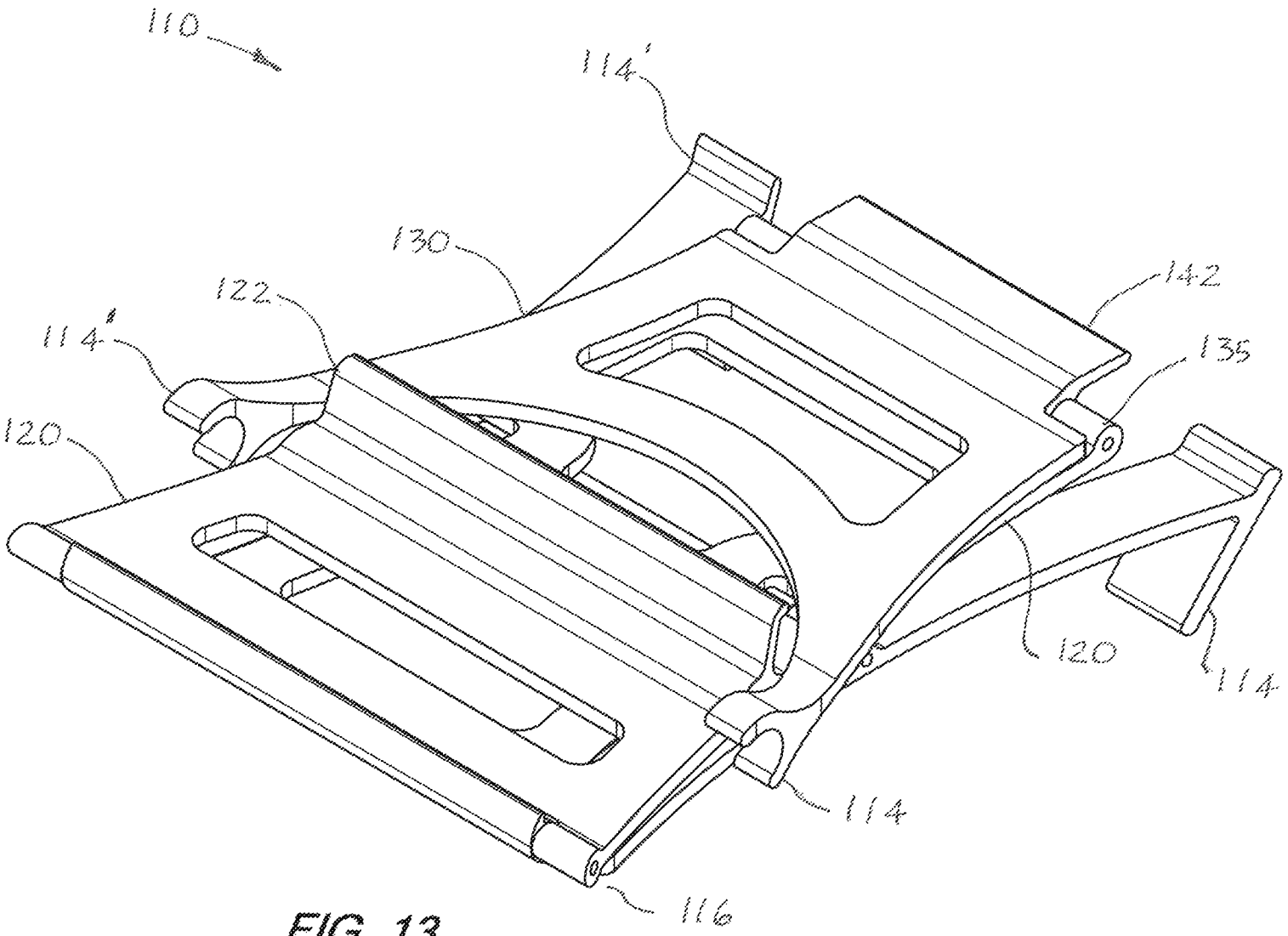
FIG. 13 is a front perspective view of the intermediate member and upper member folded into a compact configuration over the lower member.

As shown more clearly in FIGS. 11 and 13, the lateral edges of the intermediate member 120 and the upper member 130 are curved and form two continuous arcs when the headrest stand 110 is extended. When folded for compact storage, the lower ledge 122 partially extends through the large center void 132 forming a planar, compact, folded structure.

Also formed on the intermediate member 120 are two slots 125, 126 that aligned with the hinge knuckles 113 (one shown only) on the lower member 112 used with hinge used to attach the stop leaf 80 to the lower member 112 pivotally. During use, the hinge knuckles 113 partially extend through the slots 125, 126, which allow the intermediate member 120 to stack directly over the lower member 112.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A headrest stand for use on a support surface, comprising:

a. a lower member that includes a proximal edge and a distal edge, attached or formed on said proximal edge is at least one downward extending lip configured to capture an edge on said support surface;

b. an upper member that includes a lower edge that is pivotally attached to said distal edge on said lower member, said upper member includes two opposite support arms and a center void located between said two support arms, each said support arm includes a U-shaped saddle clip;

c. a headrest assembly including a U-shaped body configured to fit around a user's forehead, said headrest assembly includes two outward extending hubs, each said hub configured to be inserted into one said saddle clip formed on said support arm and support said U-shaped body inside said center void located between said support arms and allow said U-shaped body to freely rotate; and d. a stop leaf pivotally attached at one end to said lower member, said stop leaf configured to pivot upward from said lower member and press against said upper member and hold said upper member diagonally over said lower member.

2. The headrest stand, as recited in claim 1, further including a cutout formed on said lower member in which said stop leaf member is positioned when said stop leaf is axially aligned with said lower member.

3. The headrest stand, as recited in claim 2, further includes a slot or a detent formed on said upper member configured to engage said stop leaf when said stop leaf is diagonally aligned and presses against said upper member.

4. The headrest stand, as recited in claim 2, further including a ledge located on said lower member, said ledge extends outward from said upper member to hold a book or a device over said upper member.

5. The headrest stand, as recited in claim 1, further including a slot or detent formed on said upper member that engages said stop leaf when said stop leaf is diagonally aligned with said lower member.

6. The headrest stand, as recited in claim 5, further including a ledge located on said lower member, said ledge extends outward from said upper member to hold a book or device over said upper member.

7. The headrest stand, as recited in claim 5, further including a cutout formed on said lower member that receives said stop leaf member axially aligned with said lower member.

8. The headrest stand as recited in claim 1, further including an intermediate member located between said lower member and said upper member, said intermediate member being pivotally attached to said lower member and pivotally attached to said upper member.

9. The headrest stand as recited in claim 8, further including a lower ledge attached to said intermediate member.

10. The headrest stand as recited in claim 9, further including an upper ledge.

11. The headrest stand as recited in claim 10, wherein said upper ledge is formed or attached to said upper member.

12. The headrest stand as recited in claim 10, wherein said intermediate member includes an upper void area configured to receive said upper ledge formed on said upper member when said upper member is rotated and folded over said intermediate member.

13. The headrest stand as recited in claim 10, further including an extension leaf formed on said upper member that allows said upper member to rotate forward and prevents said upper member from rotating beyond an axially aligned position with said intermediate member.

14. The headrest stand as recited in claim 8, wherein said center void formed on said upper member is configured so that said lower edge formed on said intermediate member extends into said center void enabling said upper member to fold over said intermediate member.

15. The headrest stand as recited in claim 1, further including a stop surface formed on said first ledge configured to limit rotation of said upper member on said lower member.

16. The headrest stand as recited in claim 8, further including a stop surface formed on said first ledge configured to limit rotation of said intermediate member on said lower member.

17. The headrest stand as recited in claim 9, further including an extension lip formed on said upper member configured to limit rotation of said upper member over said intermediate member.

18. The headrest stand, as recited in claim 1, further including a ledge located on said lower member.

19. The headrest stand, as recited in claim 18, further including a leg located on said ledge configured to press against said upper member and limit the rotation of said upper member over said lower member.

* * * * *